US006753774B2

(12) United States Patent
Pan et al.

(10) Patent No.: US 6,753,774 B2
(45) Date of Patent: Jun. 22, 2004

(54) ANTITHEFT SYSTEM WITH SIGNALS TRANSMITTED BY MOBILE PHONE NETWORK

(76) Inventors: Tung-Hsing Pan, 3F, No. 12, Alley 15, Lane 71, Sec. 1, Shi-Pei Rd., Peitou, Taipei (TW); Mei-Jiuan Chen, No. 65, Sec. 1, Min-Sheng E. Rd., Taipei (TW); Hsi-Che Lee, No. 6, Lane 99, Chang Ji St., Taipei (TW)

( * ) Notice: Subject to any disclaimer, the term of this patent is extended or adjusted under 35 U.S.C. 154(b) by 74 days.

(21) Appl. No.: 10/279,938

(22) Filed: Oct. 25, 2002

(65) Prior Publication Data

US 2004/0080410 A1 Apr. 29, 2004

(51) Int. Cl.[7] ..... G08B 1/08

(52) U.S. Cl. ..... 340/539.11; 340/937; 340/425.5; 340/426.1; 340/539.25; 348/14.01; 455/410

(58) Field of Search ..... 340/539.11, 904, 340/937, 425.5, 426.1, 426.18, 426.2, 539.13, 539.25; 348/14.01, 14.02; 455/410, 426.1

(56) References Cited

U.S. PATENT DOCUMENTS 4,775,997 A * 10/1988 West et al. ..... 455/557
5,572,204 A * 11/1996 Timm et al. ..... 340/988
6,101,403 A * 8/2000 Masuda ..... 455/569.2
6,192,257 B1 * 2/2001 Ray ..... 455/566

* cited by examiner

*Primary Examiner*—Daryl Pope
(74) *Attorney, Agent, or Firm*—Birch, Stewart, Kolasch & Birch, LLP

(57) ABSTRACT

An antitheft system with signals transmitted by mobile phone network comprising a CPU, a video signal converter, a plurality numbers of video cameras, an audio signal converter, an audio/video compression/decompression circuitry, a hard disk drive, a mobile phone interface and an I/O interface. The captured audio and video signals can be transmitted to the carrying mobile phone of the house owners on remote site with another mobile phone wirelessly.

2 Claims, 1 Drawing Sheet

ANTITHEFT SYSTEM WITH SIGNALS TRANSMITTED BY MOBILE PHONE NETWORK

BACKGROUND OF THE INVENTION

I. Field of the Invention

This invention relates generally to an antitheft system with signals transmitted by mobile phone network and, more specifically, to an antitheft system with signals transmitted by mobile phone network that transmits audio and video signals to the carrying mobile phone of the house owners on remote sites with another mobile phone wirelessly.

II. Description of the Prior Art

Heretofore, it is known that a antitheft system is made of electronic or mechanical sensors installed on window and door entrances, these sensors detect vibration or motion of objects to trigger alarm signals for antitheft effect.

Another type of antitheft system applies laser beam or regular light detectors; when light beam is blocked, the alarm system is triggered for antitheft purpose. The laser beam or regular light detectors must be installed in pairs that might causes troublesome in wiring; in order to achieve better effect, multiple reflecting mirrors have to be installed for multiple reflecting paths to achieve denser beam net to reduce the numbers of the light beam generators and light beam detectors. The cost to apply laser beam as light source is very expensive, therefore this method only applies in strictly security requirement.

Home antitheft systems are usually link to central monitoring center or police station monitoring system, they have to be connected together with cables and wires; wiring causes inconvenience and troublesome in connection and transmission, wiring might be very costly.

Upon burglar intrusion, only central monitoring center or police station monitoring system can aware right away, the house owners might not know immediately. Once there are visitors and the house owner is not at home, house owner will not aware at all, that causes visitors' confusion and inconvenience.

Another known prior art applies existing telephone network for remote monitor and auto alarm system to transmit image and alarm signals, however telephone wire transmission can only apply to certain locations, such as police station, security center, house owners' offices. Only upon burglar intrusion, police station, security center will send people and check the abnormal situation the sites; such scheme cannot achieve two-way communication. To the house owners the two-way monitoring system only applies on the locations with telephone wiring, two-way monitoring system cannot apply to the spots without telephone wiring, that causes blind spots. Another disadvantage of the telephone wiring system is the wires would be damaged easily accidentally or purposely.

SUMMARY OF THE INVENTION

It is therefore a primary object of the invention to provide an antitheft system with signals transmitted by mobile phone network to transmit audio and video signals with mobile phone network wirelessly and remotely.

It is an objective of this invention to provide an antitheft system with signals transmitted by mobile phone network that can do two-way transmission; users can directly control the system in distance.

It is still an objective of this invention to provide an antitheft system with signals transmitted by mobile phone network that multiple locations can install video cameras simultaneously for multiple spot monitoring effect.

In order to achieve the objective set forth, an antitheft system with signals transmitted by mobile phone network in accordance with the present invention comprises a CPU, a video signal converter, a plurality numbers of video cameras, an audio signal converter, an audio/video compression/decompression circuitry, a hard disk drive, a mobile phone interface and an I/O interface. The video signal converter connects to a plurality numbers of video cameras for multi-point monitor; the audio signal converter connects to signal amplifier, speakers and microphones; the mobile phone interface connects to mobile phones; the I/O interface connects to a push button. Based on above structure, the push button is installed on the front gate, visitors press the push button to start the cameras to capture video images and microphone to input audio signals, the video images and audio signals are transmitted by a mobile phone to house owner's another mobile phone, the house owner can aware who the visitors are remotely. The camera captured video images can also be control by software; on intrusion, the warning messages can be sent by the mobile phone to house owner's another mobile phone remotely.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
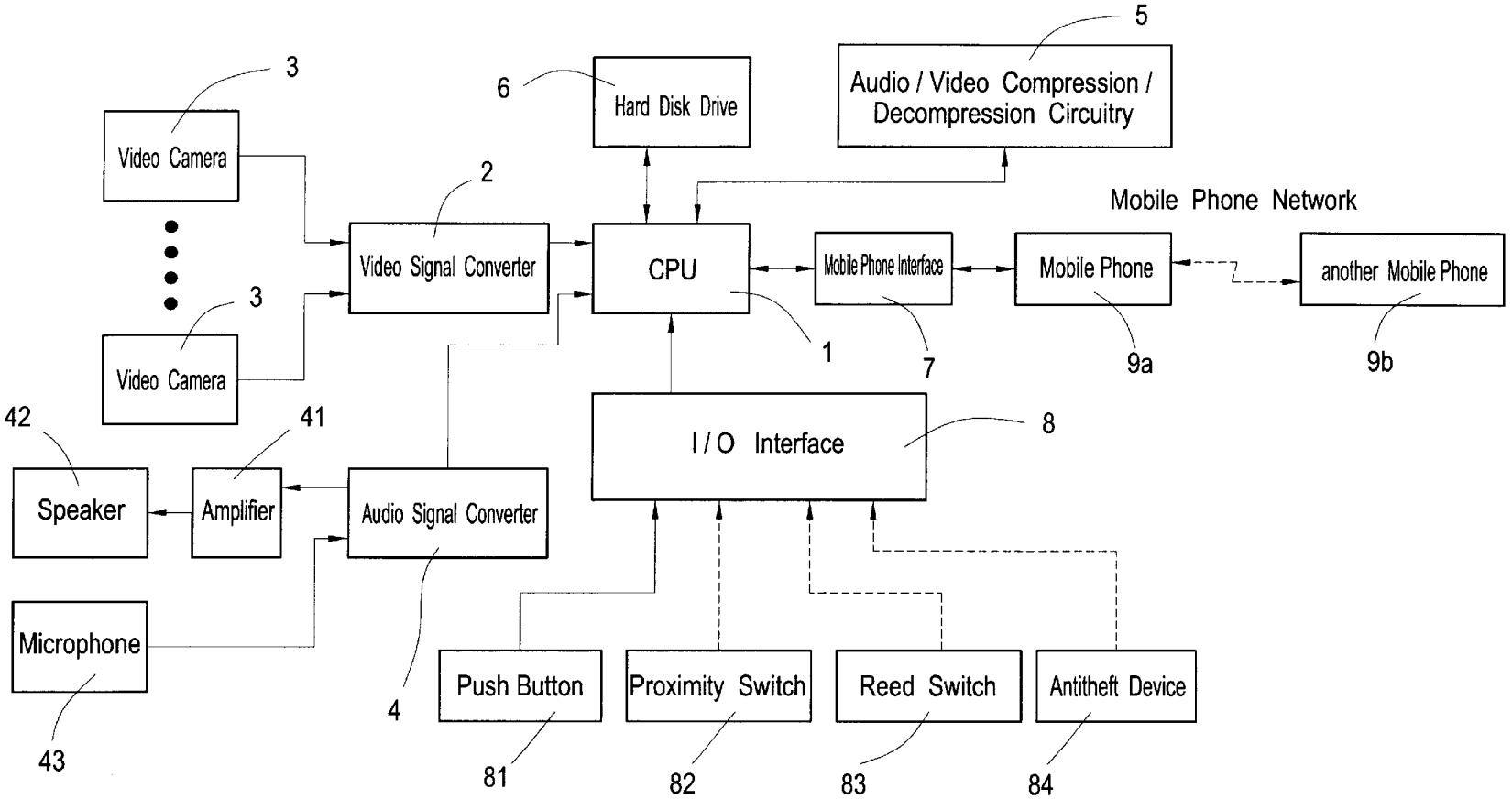
FIG. 1 is a block diagram of the present invention.

Referring to FIG. 1, the present invention is composed of a CPU (1), a video signal converter (2), a plurality numbers of video camera (3), an audio signal converter (4), an audio/video compression/decompression circuitry (5), a hard disk drive (6), a mobile phone interface (7) and an I/O interface (8). The functions of each component are described below:

The CPU (1) controls the internal circuitries of the present invention.

The video signal converter (2) connects to the CPU (1); the video signal converter (2) converts analog video signals into digital video signals and send those to the CPU (1).

A plurality numbers of video camera (3) each links to a video signal converter (2); the video camera (3) captures video signals and sends the video signals to the video signal converter (2).

The audio signal converter (4) connects to the CPU (1); the audio signal converter (4) also connects in serial with an amplifier (41), a speaker (42) and a microphone (43); the microphone (43) receives the analog audio signals, the audio signal converter (4) converts the analog audio signals into digital audio signals and sends them to the CPU (1); or the CPU (1) sends the digital audio signals into the audio signal converter (4) that converts the digital audio signals into analog audio signals, being amplified by the amplifier (41), finally output through the speaker (42).

The audio/video compression/decompression circuitry (5) connects to the CPU (1); the audio/video compression/decompression circuitry (5) compresses or decompresses the audio and video signals received.

The hard disk drive (6) connects to the CPU (1); the hard disk drive (6) stores above audio and video signals.

The mobile phone interface (7) connects to the CPU (1); the other side of the mobile phone interface (7) connects to a mobile phone (9*a*); the mobile phone (9*a*) transmits and receives audio and video signals to and from the mobile phone network.

The I/O interface (8) connects to the CPU (1); a push button (81) is on the I/O interface (8) to trigger the starting signal.

Based on the structure described above, the push button (81) and one of the video camera (3) are installed on the front gate (the other video camera (3) are installed on the other monitoring spots). When visitors come in, they can push the push button (81) as doorbell to start the process, the starting signals can be transmitted to the CPU (1) through the I/O interface (8), a control signal issued by the CPU (1) and converted by the video signal converter (2) to have the video camera (3) capturing images; the captured analog video image signals are converted into digital signals by the video signal converter (2) and sent to the CPU (1) and the audio/video compression/decompression circuitry (5); the digital video signals are compressed by the audio/video compression/decompression circuitry (5) and transmitted to the mobile phone interface (7), a mobile phone (9*a*) then transmits the image signals to another mobile phone (9*b*) with image transmission function of the house owner.

Visitors can input analog audio signals with a microphone (43), the analog audio signals are converted into digital signals by the audio signal converter (4) and sent to the CPU (1) and the audio/video compression/decompression circuitry (5); the digital audio signals are compressed by the audio/video compression/decompression circuitry (5) and transmitted to the mobile phone interface (7), a mobile phone (9*a*) then transmits the audio signals to another mobile phone (9*b*) of the house owner.

The house owner's audio signals are issued by the mobile phone (9*b*) and received by another mobile phone (9*a*); the audio signals from the owner are received by the mobile phone (9*a*) and gone through the mobile phone interface (7) and the CPU (1), then decompressed by the audio/video compression/decompression circuitry (5), the de-compressed audio signals are converted by the audio signal converter (4) into analog format and amplified by the amplifier (41) and then output from the speaker (42), house owner and visitors can dialog directly.

The video camera (3) can be installed on other window and door entrances, a software monitors the images; the software compares two consecutive images; CPU (1) will issue video and audio warning messages if any image changes; those warning messages pass through the mobile phone interface (7) from mobile phone (9*a*) to mobile phone (9*b*), central monitor center or police/community security center. Therefore even if the house owner is not at home, the house owner, security guards or policemen can aware of the intrusion.

Based on above description, all the signals are transmitted wirelessly; as long as the mobile phone (9*b*) is on, the house owner can receive the signals in all the time and at all the locations, such as driving, inside an automobile, in the meeting . . . The house owner can also apply the carrying mobile phone (9*b*) through mobile phone network to check who is visiting; the visitor can also dialog directly to avoid the inconvenience while house owner is absent. House owner can apply mobile phone (9*b*) to see the images captured by the video camera (3) once there is a break-in, such scheme can achieve antitheft effect.

House owner can also dial the carrying mobile phone (9*b*) through the mobile phone network to another mobile phone (9*a*) at home; the video signals captured by the video camera (3) can be transmitted back to the mobile phone (9*b*) held by the house owner, house owner can check the house condition remotely; house owner can do the proper processes once there is abnormal situation happens. This scheme achieves a two-way transmission effect.

A hard disk drive (6) records all the in-progress audio and video signals for future reference.

The I/0 interface (8) not only link to the front gate as doorbell but can also act as a push button (81) of the warning bell in the security center. The I/O interface (8) can also link to a proximity switch (82), an reed switch (83) or other antitheft device (84); the proximity switch (82) and the reed switch (83) can be installed in the door and window entrances that burglars intrude; the other antitheft device (84) can be installed on other monitoring spots for antitheft monitoring, image recording and other purposes.

While a preferred embodiment of the invention has been shown and described in detail, it will be readily understood and appreciated that numerous omissions, changes and additions may be made without departing from the spirit and scope of the invention.

What is claimed is:

1. An antitheft system with signals transmitted by mobile phone network comprising:

a CPU controlling the internal circuit;

a video signal converter being connected to said CPU, used to convert analog video signals into digital video signals and send those to said CPU;

a plural numbers of video camera each being linked to a said video signal converter, used to capture video signals and send the video signals to said video signal converter;

an audio signal converter being connected to said CPU and serial with an amplifier, a speaker and a microphone, said microphone receives the analog audio signals, said audio signal converter converts the analog audio signals into digital audio signals and sends them to said CPU, or said CPU sends the digital audio signals into said audio signal converter that converts the digital audio signals into analog audio signals, being amplified by said amplifier, finally output through said speaker;

an audio/video compression/decompression circuitry being connected to said CPU, used to compress or decompress the audio and video signals received;

a hard disk drive being connects to said CPU, used to store above audio and video signals;

a mobile phone interface being connected to said CPU and a mobile phone for transmitting and receiving audio and video signals to and from the mobile phone network;

an I/O interface being connected to said CPU, a push button on the I/O interface to trigger the starting signal.

2. The antitheft system with signals transmitted by mobile phone network recited in claim 1, wherein said I/O interface being connected to a proximity switch, an reed switch or other antitheft devices.

* * * * *